US009758291B2

(12) United States Patent
Weigand et al.

(10) Patent No.: US 9,758,291 B2
(45) Date of Patent: Sep. 12, 2017

(54) PORT ARRANGEMENT FOR AN INTERNAL COMPONENT

(75) Inventors: Peter Weigand, Bad Vilbel (DE); Gunter Quass, Frankfurt am Main (DE); Jens von Waaden, Frankfurt am Main (DE)

(73) Assignee: AIR LIQUIDE GLOBAL E&C SOLUTIONS GERMANY GMBH, Frankfurt am Main (DE)

( * ) Notice: Subject to any disclaimer, the term of this patent is extended or adjusted under 35 U.S.C. 154(b) by 673 days.

(21) Appl. No.: 13/512,374

(22) PCT Filed: Nov. 18, 2010

(86) PCT No.: PCT/DE2010/001351

§ 371 (c)(1),
(2), (4) Date: May 29, 2012

(87) PCT Pub. No.: WO2011/098057

PCT Pub. Date: Aug. 18, 2011

(65) Prior Publication Data

US 2012/0234841 A1 Sep. 20, 2012

(30) Foreign Application Priority Data

Feb. 9, 2010 (DE) ..... 10 2010 007 498

(51) Int. Cl.
*B65D 90/48* (2006.01)
*B65D 81/38* (2006.01)

(52) U.S. Cl.
CPC ..... *B65D 81/38* (2013.01); *B65D 90/48* (2013.01)

(58) Field of Classification Search
CPC ..... B65D 90/48; B65D 81/38
USPC ..... 220/676, 601, 661, 560.04, 320, 321, 220/545, 567.1, 567.2, 567.3, 918–921; 137/264
See application file for complete search history.

(56) References Cited

U.S. PATENT DOCUMENTS 1,095,759 A * 5/1914 White ..... 220/651
1,432,888 A * 10/1922 Murray ..... 220/569
4,522,034 A * 6/1985 Laskaris ..... 62/51.1
4,526,015 A * 7/1985 Laskaris ..... 62/51.1
(Continued)

FOREIGN PATENT DOCUMENTS

CA 1322900 C 10/1993
DE 1573289 B1 4/1970
(Continued)

OTHER PUBLICATIONS

European Patent Office, International Search Report in International Patent Application No. PCT/DE2010/001351 (May 25, 2011).
(Continued)

*Primary Examiner* — Anthony Stashick
*Assistant Examiner* — James Way
(74) *Attorney, Agent, or Firm* — Leydig, Voit & Mayer, Ltd.

(57) ABSTRACT

A port arrangement is configured for accessing a demountable component in an interior of an apparatus or container. The port arrangement includes an inner port having a port tube and forming a releasable connection with an internal component. The port tube of the inner port is guided through an outer port that is to an outer jacket.

7 Claims, 3 Drawing Sheets

(56) References Cited

U.S. PATENT DOCUMENTS

| | | | | |
|---|---|---|---|---|
| 4,572,402 | A | 2/1986 | Gervais et al. | |
| 4,655,045 | A | 4/1987 | Matsumoto | |
| 4,674,289 | A | 6/1987 | Andonian | |
| 4,705,189 | A * | 11/1987 | Theissen et al. | 220/560.11 |
| 4,790,290 | A * | 12/1988 | Chevalier et al. | 122/19.2 |
| 5,121,705 | A | 6/1992 | Sugino | |
| 7,775,391 | B2 * | 8/2010 | Harper | 220/560.1 |

FOREIGN PATENT DOCUMENTS

| | | | |
|---|---|---|---|
| DE | 1675365 | A1 | 12/1970 |
| DE | 2925633 | A1 | 1/1981 |
| DE | 8305747 | U1 | 2/1984 |
| DE | 0209003 | A2 | 1/1987 |
| DE | 19629138 | A1 | 1/1998 |
| EP | 0375656 | A2 | 6/1990 |
| FR | 93180 | E | 2/1969 |
| GB | 1096748 | A | 12/1967 |
| GB | 1221676 | A | 2/1971 |

OTHER PUBLICATIONS

Hermann Franke, "Lueger, Lexikon der Technik", 1970, vol. 16, Deutsche Verlags—Anstalt Stuttgart, Germany; pp. 489-490.

* cited by examiner

PORT ARRANGEMENT FOR AN INTERNAL COMPONENT

CROSS REFERENCE TO RELATED APPLICATIONS

This application is a U.S. National Phase application under 35 U.S.C. §371 of International Application No. PCT/DE2010/001351, filed on Nov. 18, 2010, and claims benefit to German Patent Application No. DE 10 2010 007 498.5, filed on Feb. 9, 2010. The International Application was published in German on Aug. 18, 2011 as WO 2011/098057 A1 under PCT Article 21 (2).

FIELD

This invention relates to a port arrangement for access to a demountable component located in the interior of an apparatus or container, comprising a port connected with the internal component, whose port tube is guided through a port connected with the outer jacket.

BACKGROUND

Port arrangements can provide access to a separate space located in the interior of an apparatus or container. These applications usually exist in containers equipped with a heating or cooling jacket, when the access to the product or reaction space extends through the heating or cooling jacket. In Lueger, "Lexikon der Technik", 1970, Vol. 16, for example, a port arrangement for the interior of a double-walled container is described, in which sealing between the outer container wall and the port tube extending through the same is effected by means of a stuffing box. In this way, a movement caused e.g. by thermal expansion is permitted between the inner and the outer apparatus wall.

Another construction is illustrated in the drawing, FIG. 1. Here, the port 10 of the inner jacket 12 is concentrically guided through a second port 14 located flush in the outer jacket 13 of the container. The flanges of the ports 15, 16 are screwed to each other, so that the space between inner jacket and outer jacket is sealed. A compensator 17 provides for a mutual displacement of the inner jacket relative to the outer jacket due to thermal expansion. The port 10 is closed by a blind flange 18. The blind flange 18 can also be provided with a cylindrical displacer, which in the mounted condition protrudes into the port 10 e.g. up to the inner jacket 12, in order to prevent deposits in the port 10.

In the German Utility Model G 83 05 747.1 a lead-through is described, in which the inner port tube is equipped with a compensator and the outer port tube is divided in two, wherein the first part is welded to the inner jacket and the second part is welded to the outer jacket of the container and the two parts are connected via a bearing shell made of a material with low thermal conductivity. By means of this construction, a conduction of heat between inner and outer jacket of the container via this port tube should be avoided.

In DE-AS 1 573 289 a temperature sensor arrangement is described, which should also be suitable as lead-through for other measuring purposes. The so-called temperature sensor is a rotationally symmetric, tubular rotary part which is equipped with a flange at its upper end and with a thread at its lower end. To use the same as a lead-through for e.g. measuring sensors, this part is introduced into a hole in the wall of the inner jacket from the interior of the inner jacket, with the threaded end first, and screwed to a nut. This screw connection at the same time serves for attachment of one end of a bellow to the wall of the inner jacket, whose other end is attached to the outer jacket, so that the temperature sensor and the bellow together form a lead-through into the internal component. It is disadvantageous in this arrangement that the temperature sensor must be introduced into the hole in the wall of the inner jacket from the inside of the internal component. In practice, however, the good accessibility of the mounting point necessary for this purpose, is not always ensured.

A disadvantage of the constructions as described in FIG. 1 and in G 83 05 747.1 consists in that they are exclusively suitable for internals firmly installed in the apparatus or container. For internals which should be removable from the apparatus, e.g. for inspection or repair, these ports are less suitable, since they must be cut off from the component to be removed, in order to provide for this procedure. Such cutting off, and also the subsequent reattachment of the port arrangement, requires a great effort.

SUMMARY

In an embodiment, the present invention provides a port arrangement for accessing a demountable component in an interior of an apparatus or container. The port arrangement includes an inner port having a port tube and forming a releasable connection with an internal component. The port tube of the inner port is received through an outer port that is connected with an outer jacket.

DETAILED DESCRIPTION

An aspect of the present invention provides a port arrangement in which the port connected with the internal component can easily be separated from the same, and for mounting the same a good accessibility of the interior of the internal component is not absolutely necessary.

In an embodiment, the present invention provides that that the port of the port arrangement connected with the internal component is mounted to the internal component with a releasable connection.

The port arrangement can serve to introduce measurement and observation means into the internal component, but it can also be used for the supply and discharge of fluids.

A preferred aspect of the invention is characterized in that the sealing element of the releasable connection consists of cones inserted into each other, and the force for pressing the parts of the sealing element into each other is generated by pretensioning an expansion compensator integrated in the tube of the inner or outer port.

The cones can have a substantially round or square cross-section or the cross-section of an isosceles triangle. Another preferred aspect of the invention is characterized in that the sealing element of the releasable connection consists of one hemisphere and one shell half inserted into each other.

In connections of this type, sealing surfaces are pressed onto each other and a force thereby is exerted by the outer jacket onto the inner jacket. To absorb this force, the internal component correspondingly must be firmly installed in the container or apparatus.

The sealing surfaces of the sealing elements usually are coated with a sealing material.

It is also possible that the sealing element of the releasable connection consists of a threaded screw connection. In this case, no force is required for pressing the parts of the sealing element on or in each other.

The invention and a few embodiments of the invention will now be explained with reference to the following examples and drawings.

All features described and/or illustrated form the subject-matter of the invention per se or in any combination.

Figure 1:
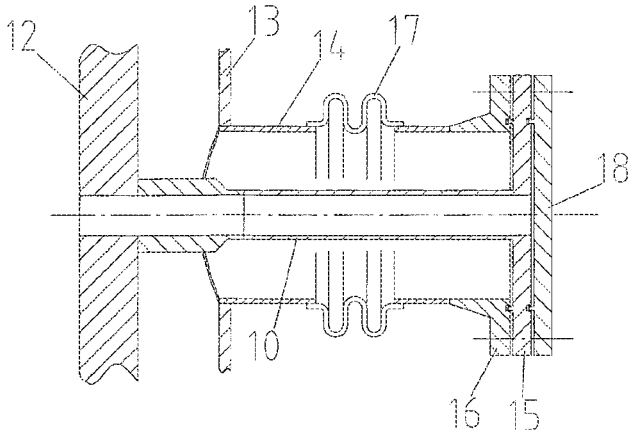
FIG. 1 shows a port of an inner jacket that is concentrically guided through a second port located flush in the outer jacket of a container.
Figure 2:
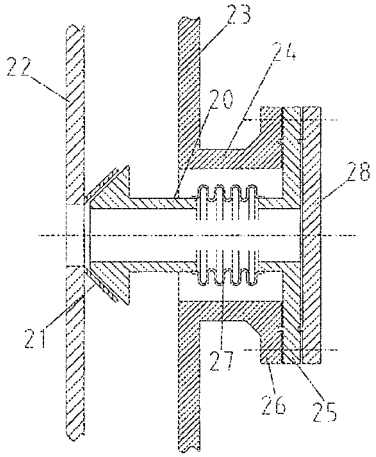
FIG. 2 shows a port in accordance with an embodiment of the invention, which is connected with an inner jacket of a component via a conical sealing element.

FIG. 2 shows a port 20 in accordance with an embodiment of the invention, which is connected with the inner jacket 22 of a component via a conical sealing element 21. The port 20 is concentrically guided to the outside through a port 24 connected with the outer jacket 23 of a container. The flanges 25, 26 of the ports are screwed to each other. The expansion compensator 27 is tensioned and the necessary pressing force for the conical sealing element 21 is generated. The port 20 is closed by a blind flange 28.

Figure 3:
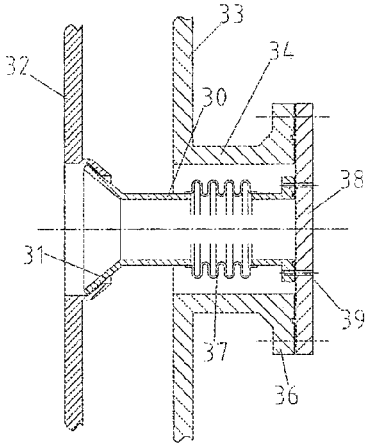
FIG. 3 shows the jacket of an internal component, the outer jacket of a container, and an inner port which is guided through an outer port.

FIG. 3 shows the jacket 32 of an internal component, the outer jacket 33 of a container, and the port 30 which is guided through the port 34. The port 30 is connected with the jacket 32 via the conical sealing element 31. The flange of the port 30 is directly connected with the blind flange 38 by screws 39. By means of the screws 39 the port 30 is drawn against the blind flange 38, whereby the compensator 37 is tensioned and the pressing force for the sealing element 31 is generated. This variant takes advantage of a good accessibility of the interior of the internal component for assembly of the inner port tube. It is particularly suitable when a high pressure exists in the internal component, as in this mounting direction the same supports pressing down the sealing surfaces of the sealing element 31.

Figure 4:
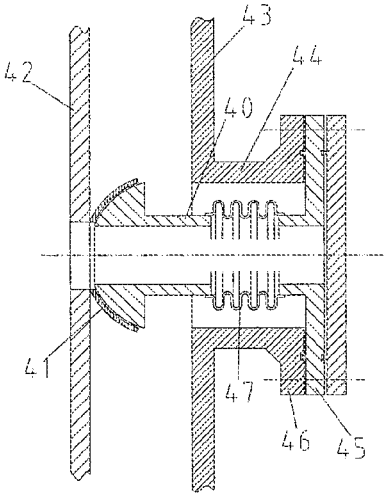
FIG. 4 shows a construction variant in which the sealing element, by which the inner jacket is connected with the port, consists of one hemisphere and one shell half inserted into each other.

FIG. 4 shows a construction variant in which the sealing element 41, by which the inner jacket 42 is connected with the port 40, consists of one hemisphere and one shell half inserted into each other. This variant is preferred when lateral displacements between the port 40, 44 of the inner jacket 42 and of the outer jacket 43 must be expected. A slight bend in the tube of the port 40 is permitted by the compensator 47.

Figure 5:
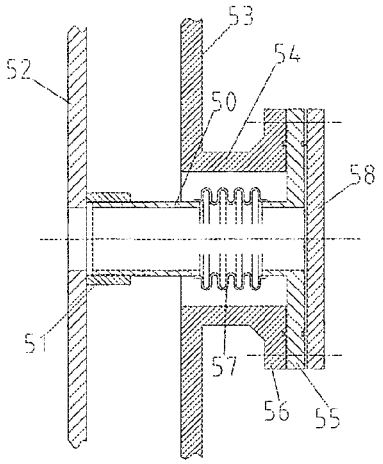
FIG. 5 shows a construction variant which is particularly suitable when a high tightness of the sealing element is desired.

FIG. 5 shows a construction variant which is particularly suitable when a high tightness of the sealing element 51 is required. The sealing element 51 consists of a threaded joint via which the inner jacket 52 is connected with the port 50. The compensator 57 serves to permit minor lateral displacements of the port 50 relative to the port 54 of the outer jacket 53. The port flanges 55, 56 are screwed to each other. The port 50 is closed by the blind flange 58.

While the invention has been particularly shown and described with reference to preferred embodiments thereof, it will be understood by those skilled in the art that various changes in form and details may be made therein without departing from the spirit and scope of the invention.

What is claimed is:

1. A port arrangement for accessing a demountable component in an interior of an apparatus or container, the port arrangement comprising:

an inner port including a port tube and forming a non-integral, releasable connection with an internal component, the releasable connection being pretensioned so as to provide a pressing force which presses the port tube toward and against the internal component; and an outer port connected with an outer jacket, the port tube of the inner port being received through the outer port.

2. The port arrangement recited in claim 1, wherein the connection between the inner port and internal component is formed by a sealing element including cones inserted within one another, and wherein at least one of the port tube of the inner port and a port tube of the outer port includes an expansion compensator integrated therein and configured to provide the pressing force.

3. The port arrangement recited in claim 2, wherein the cones have a round cross-section.

4. The port arrangement recited in claim 2, wherein the cones have a cross section of an isosceles triangle.

5. The port arrangement recited in claim 1, wherein the connection between the inner port and internal component is formed by a sealing element including one hemisphere and one shell half inserted into one another.

6. The port arrangement recited in claim 1, wherein the connection between the inner port and internal component is formed by a sealing element including a threaded screw connection.

7. The port arrangement recited in claim 1, wherein the port tube of the inner port has an expansion compensator and wherein the pressing force is provided by the expansion compensator.

* * * * *